US009937511B2

(12) United States Patent
Goettke

(10) Patent No.: US 9,937,511 B2
(45) Date of Patent: Apr. 10, 2018

(54) DISPENSER

(71) Applicant: RPC Bramlage GmbH, Lohne (DE)

(72) Inventor: Sabine Goettke, Lohne (DE)

(73) Assignee: RPC Bramlage GmbH, Lohne (DE)

( * ) Notice: Subject to any disclaimer, the term of this patent is extended or adjusted under 35 U.S.C. 154(b) by 0 days.

(21) Appl. No.: 15/124,792

(22) PCT Filed: Mar. 10, 2015

(86) PCT No.: PCT/EP2015/054874
§ 371 (c)(1),
(2) Date: Sep. 9, 2016

(87) PCT Pub. No.: WO2015/135891
PCT Pub. Date: Sep. 17, 2015

(65) Prior Publication Data

US 2017/0036226 A1 Feb. 9, 2017

(30) Foreign Application Priority Data

Mar. 10, 2014 (DE) ..... 20 2014 101 064 U
Aug. 26, 2014 (DE) ..... 20 2014 103 984 U

(51) Int. Cl.
*B05B 11/00* (2006.01)
*B05B 1/30* (2006.01)
*B05B 15/06* (2006.01)

(52) U.S. Cl.
CPC ..... *B05B 11/3059* (2013.01); *B05B 11/0029* (2013.01); *B05B 11/3001* (2013.01);
(Continued)

(58) Field of Classification Search
CPC ..... B05B 1/3026; B05B 11/0029; B05B 11/0048; B05B 11/3001; B05B 11/3047;
(Continued)

(56) References Cited

U.S. PATENT DOCUMENTS 3,371,827 A * 3/1968 Micallef ..... B65D 47/2012 222/507
4,998,649 A * 3/1991 Thanisch ..... B65D 47/2012 222/212
(Continued)

FOREIGN PATENT DOCUMENTS

JP S 62-199161 U 12/1987
WO 90/14897 A1 12/1990
(Continued)

OTHER PUBLICATIONS

International Search Report of PCT/EP2015/054874, dated Jun. 8, 2015.

*Primary Examiner* — Paul R Durand
*Assistant Examiner* — Bob Zadeh
(74) *Attorney, Agent, or Firm* — Collard & Roe, P.C.

(57) ABSTRACT

A dispenser for dispensing liquid to pasty masses has a storage space and a dispenser head part, wherein a dispensing outlet allocated to the dispensing head part is formed, and the dispenser head part can be turned around a rotational axis (y) from a first position that impedes dispensing actuation into a second position that yields a standby position for dispensing, wherein an actuating part can be moved along a traversing axis (x) for dispensing mass through the dispensing outlet in the second position. In order to indicate an easy to handle dispenser, an outlet part exhibiting the dispensing outlet can be provided, so that the outlet part can be radially moved in relation to the traversing axis (x) while moving the dispenser head part from the first position into the second position and vice versa.

15 Claims, 15 Drawing Sheets

Figure 1:
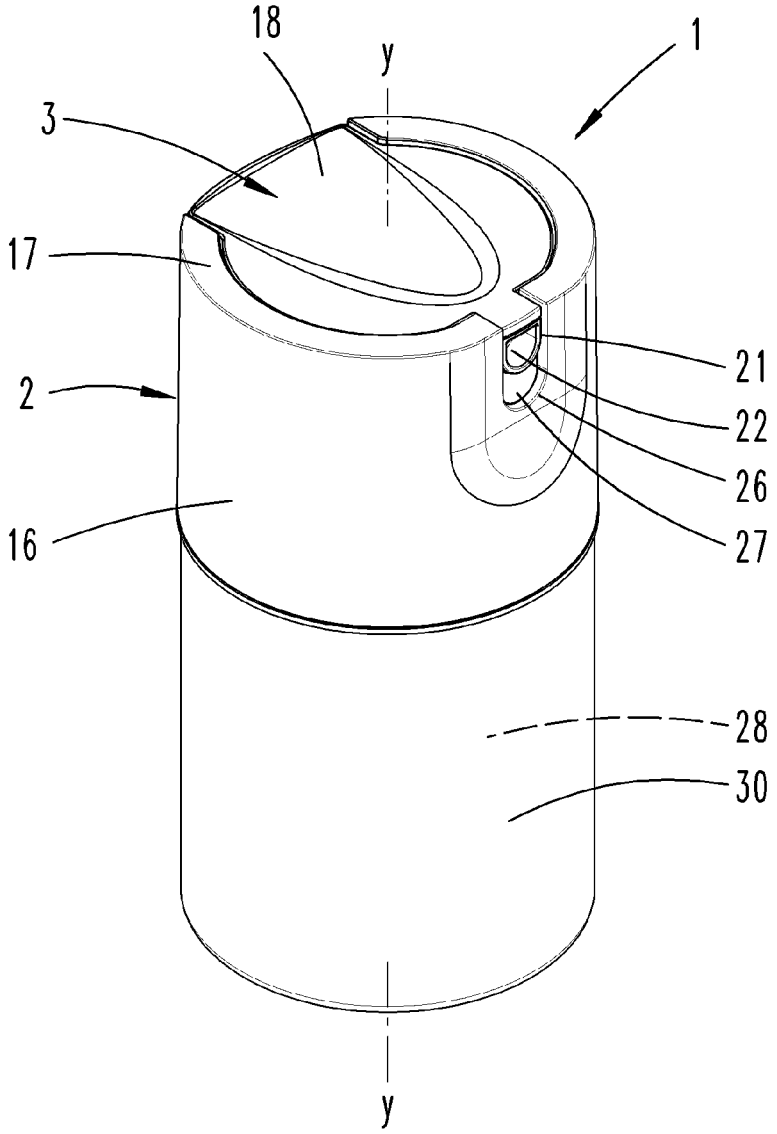

(52) U.S. Cl.
CPC ..... *B05B 11/3047* (2013.01); *B05B 11/3094* (2013.01); *B05B 15/065* (2013.01); *B05B 1/3026* (2013.01); *B05B 11/0048* (2013.01); *B05B 11/3074* (2013.01); *B05B 15/068* (2013.01)

(58) Field of Classification Search
CPC ..... B05B 11/3059; B05B 11/3094; B05B 15/065; B05B 15/068
See application file for complete search history.

(56) References Cited

U.S. PATENT DOCUMENTS 5,016,783 A * 5/1991 Hayes ..... B05B 11/0032 222/153.13
5,085,347 A 2/1992 Hayes et al.
5,090,601 A * 2/1992 Thanisch ..... B65D 47/2012 222/507
5,203,841 A * 4/1993 Kitabayashi ..... B65D 47/2043 222/402.11
6,059,154 A * 5/2000 Bigotte ..... B65D 47/2012 222/507
7,857,174 B2 12/2010 Michaux et al.
8,439,230 B2 5/2013 Hagen
9,205,439 B2 12/2015 Goettke et al.
2007/0257067 A1* 11/2007 Parmentier ..... B05B 11/3015 222/507
2008/0116232 A1* 5/2008 Michaux ..... B05B 11/3049 222/507
2010/0270336 A1* 10/2010 Camplone ..... B05B 11/0091 222/507
2017/0036226 A1* 2/2017 Goettke ..... B05B 11/0029

FOREIGN PATENT DOCUMENTS

WO 2008/056077 A2 5/2008
WO 2009/063518 A1 5/2009
WO 2009/127651 A1 10/2009
WO 2012/074162 A1 6/2012
WO 2012/074163 A1 6/2012
WO 2012/126920 A1 9/2012

* cited by examiner

DISPENSER

CROSS REFERENCE TO RELATED APPLICATIONS

This application is the National Stage of PCT/EP2015/054874 filed on Mar. 10, 2015, which claims priority under 35 U.S.C. § 119 of German Application No. 20 2014 101 064.5 filed on Mar. 10, 2014 and German Application No. 20 2014 103 984.8 filed on Aug. 26, 2014, the disclosures of which are incorporated by reference. The international application under PCT article 21(2) was not published in English.

The invention relates to a dispenser for dispensing liquid to pasty masses, with a storage space and a dispenser head part, wherein a dispensing outlet allocated to the dispensing head part is formed, and the dispenser head part can be turned around a rotational axis from a first position that impedes dispensing actuation into a second position that yields a standby position for dispensing, wherein an actuating part can be moved along a traversing axis for dispensing mass through the dispensing outlet in the second position.

For example, a dispenser of the kind in question is known from WO 2009/127651 A1. A dispenser for dispensing liquid to pasty masses is also known from WO 2012/126920 A1.

The object of the invention is to indicate a dispenser that is easy to handle.

In a first inventive idea, one possible solution to the object for a dispenser is geared toward radially moving an outlet part exhibiting the dispensing outlet in relation to the traversing axis while moving the dispenser head part from the first position into the second position and vice versa.

The outlet part exhibiting the dispensing outlet is realized so that it can be preferably independently displaced relative to the dispenser head part. As a result, the outlet part can be displaced from a first position where dispensing actuation is impeded into a second position (dispensing standby position) or vice versa. Preferably involved here is a sliding displacement of the outlet part, in particular a sliding displacement along a radial to the traversing axis and/or rotational axis. Due to the possible movability, the outlet part can be brought into a position that is easy to handle.

In particular, the traversing axis is aligned parallel to an axis that centrally intersects the dispenser, for example a rotational axis. The rotational axis of the dispenser can simultaneously be the rotational axis of the dispenser head part.

The outlet part can preferably be moved into the radially outer position (only) while rotating the dispenser head part from the first position into the second position. The dispenser head part rotation around the traversing axis can be coupled with the radial movement of the outlet part. Rotating the dispenser head part can force a radial displacement of the outlet part. The radial motion while turning the dispenser head part into the second position (dispensing standby position) can cause the outlet part to be displaced from a radially inner to a radially outer position. In this radially outer position, in particular the end of the outlet part exhibiting the dispensing outlet can project over a continuous outer wall of the dispenser head part so as to facilitate handling.

Rotationally displacing the dispenser head part back into the first position that results in a locking position preferably causes the outlet part to be correspondingly displaced from a radially outer position back into a radially inner position.

The outlet part can continue radially inward in a tube section that extends at essentially a right angle to the traversing axis. The outlet part is preferably designed as a single piece and/or integrally with the tube section.

In relation to the rotational axis, the tube section can run along a radial relative to a central axis of the tube section. The tube section can also be situated in such a way that its central axis includes an acute angle of up to 30°, for example 10 or 15°, to a radial in relation to a plane aligned perpendicular to the rotational axis.

In relation to the traversing axis, the tube section preferably passes over into a vertical tube section extending in the direction of the traversing axis. The vertical tube section preferably extends perpendicular to the tube section that empties into the outlet part.

The tube section and vertical tube section can be designed as a single piece and integrally, in particular formed as a hard plastic part.

In one possible embodiment, the vertical tube section extends concentrically to the rotational axis. The vertical tube section can also run eccentrically to the rotational axis, along an eccentric axis parallel to the axis of twist.

In an embodiment, the vertical tube section is provided so that it can rotate around the eccentric axis. The ability to rotate around the eccentric axis can be limited, for example to a rotational angle of up to 90°, further for example to 5°, 12° or 28°. Also possible in this regard is a complete rotation by 360° relative to the eccentric axis.

The vertical tube section can also be rotatable around the axis of twist, preferably both given a concentric alignment of the vertical tube section relative to the rotational axis and given an eccentric arrangement of the latter. Given an eccentric arrangement, the vertical tube section can be rotated around the eccentric axis and/or the rotational axis.

In a preferred embodiment, the vertical tube section adjoins an eccentric part. The eccentric part can be non-rotationally joined with the vertical tube section, so that the vertical tube section is turned around the eccentric axis by turning the eccentric part. The vertical tube section can also be rotatably joined with the eccentric part, as preferred, making it possible to rotationally displace the vertical tube section and eccentric section relative to each other, and also the eccentric part relative to the dispenser head part.

The eccentric part preferably exhibits a pump chamber attachment section that extends concentrically to the rotational axis, and an attachment section for the vertical tube section aligned eccentrically to the rotational axis.

The eccentric part can also exhibit attachment collars extending concentrically to the angle of twist, in particular with a bearing surface of the dispenser head part.

The outlet part can be slot guided on a rotationally fixed dispenser part. As a result, part of the slot guide can be formed in a dispenser part non-displaceably formed with a pump chamber part. This dispenser part can preferably be shifted together with the pump chamber part out of the second position (dispensing standby position) into a mass dispensing position in the direction of the traversing axis.

A sliding block can be formed on the outlet part, and a slot on the dispenser part. A sliding block can also be formed on the dispenser part, and a corresponding slot on the outlet part. The slot is preferably arranged eccentrically to the rotational axis. In conjunction with the sliding block engaging into the slot, twisting the sliding block around the rotational axis relative to the slot brings about a forcedly guided radial displacement of the outlet part exhibiting the sliding block.

The actuating part can be displaced out of the second position toward the traversing axis for dispensing the mass, in the process preferably entraining the dispenser part comprising part of the slot guide and the pump chamber part. To this end, the actuating part preferably exhibits an actuating surface, which to enhance ergonomics is preferably provided on the cover side of the dispenser.

The outlet part can be guided on the actuating part for purposes of radial movability, for example as a result of actuating part segments that laterally flank the outlet part in the displacement direction. For example, a guide can also be achieved in the form of a tongue-and-groove connection, which allows the outlet part to radially move relative to the actuating part.

The radial movability of the outlet part can be limited radially outward and/or radially inward by a stop, for example when outlet part segments protruding transverse to the displacement direction hit areas of the actuating part. The stops can also be provided above the slot guide, or take the form of stop areas provided on the actuating part.

Provided is a dispenser tube that joins a pump chamber with the outlet part. The mass charged into the dispenser exits through the dispenser tube via the outlet part side dispenser outlet when the dispenser is actuated accordingly. The described tube section and/or the vertical tube section can be part or parts of such a dispenser tube.

Given the preferred guidance of the outlet part on the actuating part, the outlet part also causes the actuating part to rotate. The dispenser tube can be situated on a receiving part extending along the traversing axis and/or rotational axis, so that it can rotate relative thereto. In this way, at least one partial section of the dispenser tube can be situated so that it can rotate around the traversing axis, and be joined with the pump chamber by means of the receiving part. The receiving part can be designed as an eccentric part.

The dispenser tube can be a hard plastic tube, which is further preferably telescopically designed to allow the radial movability of the outlet part, possibly in an additional section.

The dispenser tube can also be designed as a hose part that absorbs at least one rotation owing to elastic deformation. Such a hose part is preferably a soft plastic tube. Such a hose section can further be configured so that it can also perform the radial displacement of the outlet part in addition to the rotational movement.

The dispenser part preferably supports the actuating part so that it can rotate relative to the traversing axis, but remains motionless in the direction of the traversing axis. A relative rotational displaceability between the actuating part and dispenser part is permitted in the direction of the traversing axis, i.e., given a displacement from the second position into the mass dispensing position and vice versa, a preferably uniform axial displacement takes place.

The actuating part can preferably exhibit a locking projection that extends in the direction of the traversing axis in relation to the traversing axis opposite the outlet part. In the first position (locking position) of the dispenser head part, this projection interacts with a dispenser-fixed stop part. As a result of the support, the actuating part cannot be displaced along the traversing axis in this first position.

A rotational displacement of the dispenser head part in conjunction with the actuating part causes the projection to correspondingly shift into the second position, wherein the locking projection lies opposite an insertion recess in the dispenser-fixed area in this position. The insertion recess allows the dispenser head part to shift along the traversing axis when the locking projection plunges into the insertion recess.

Figure 2:
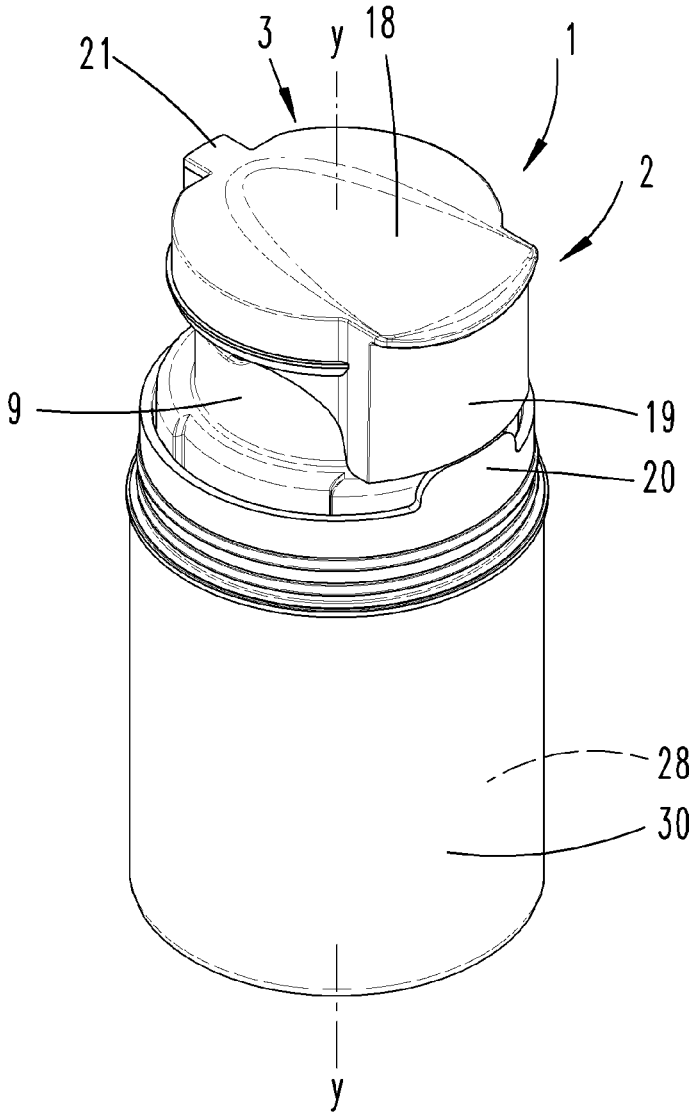
Figure 3:
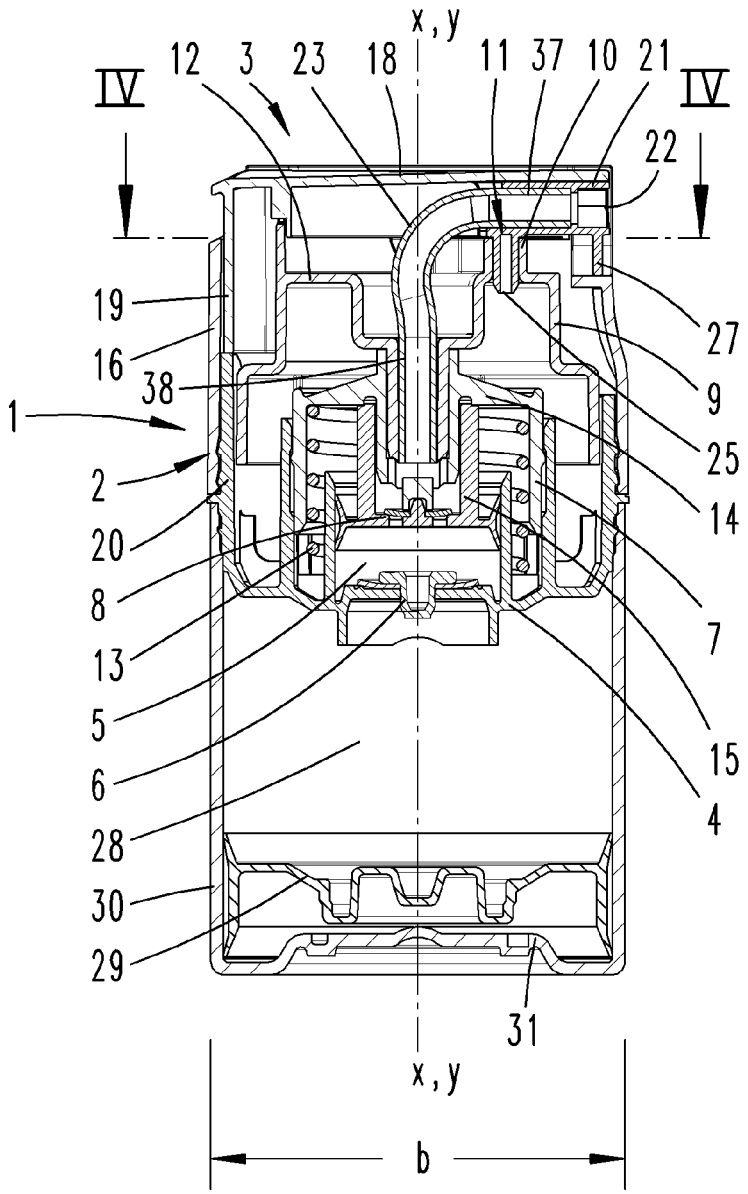
Figure 4:
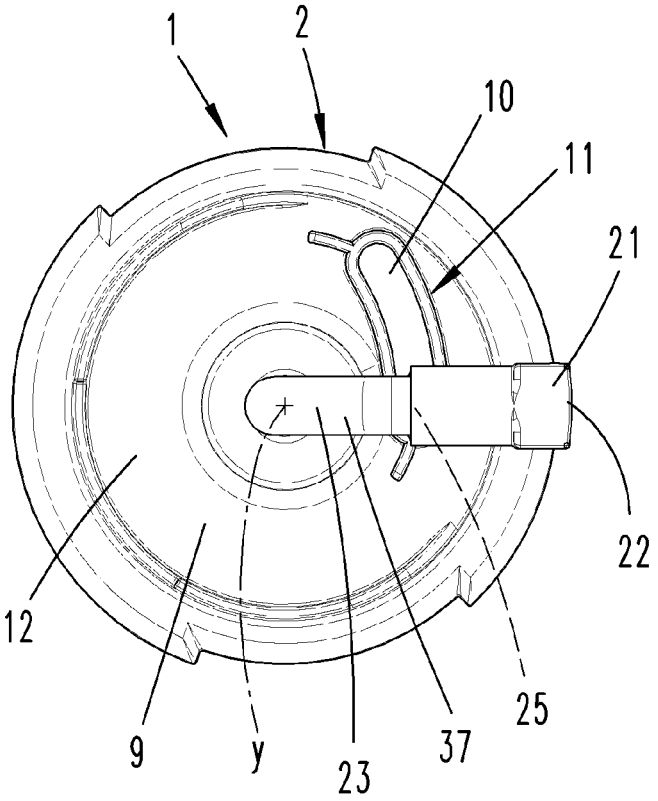
Figure 5:
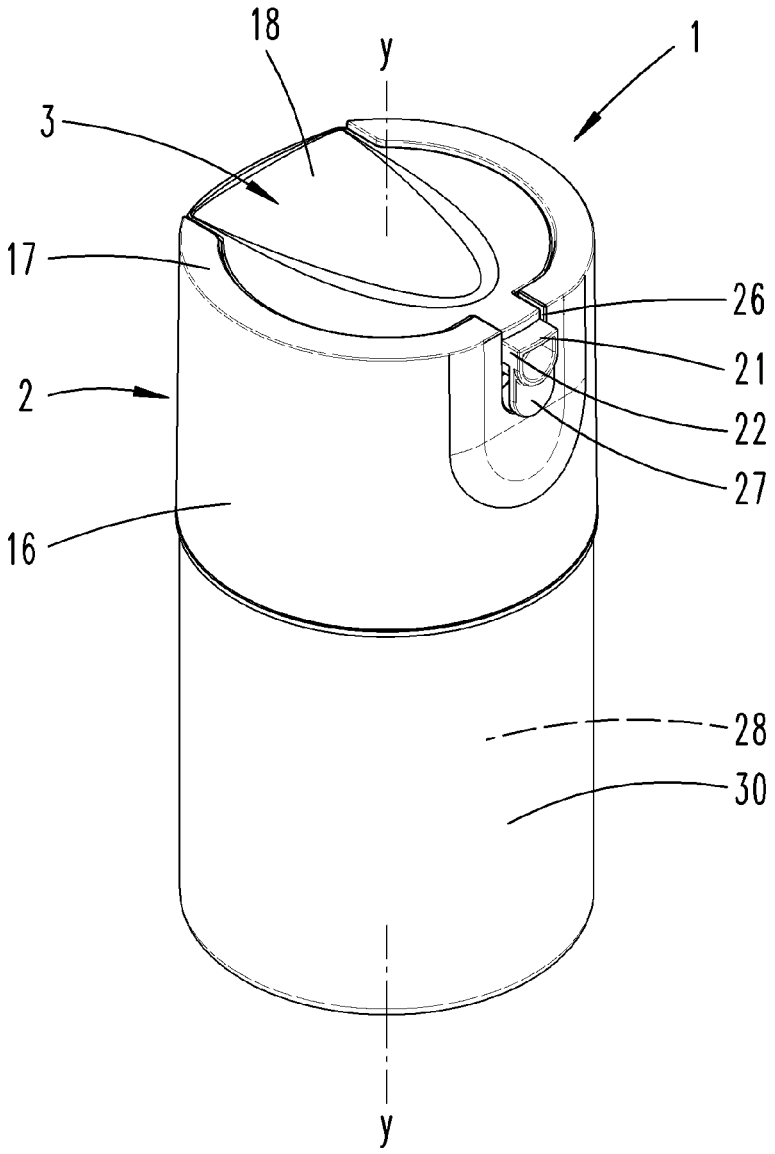
Figure 6:
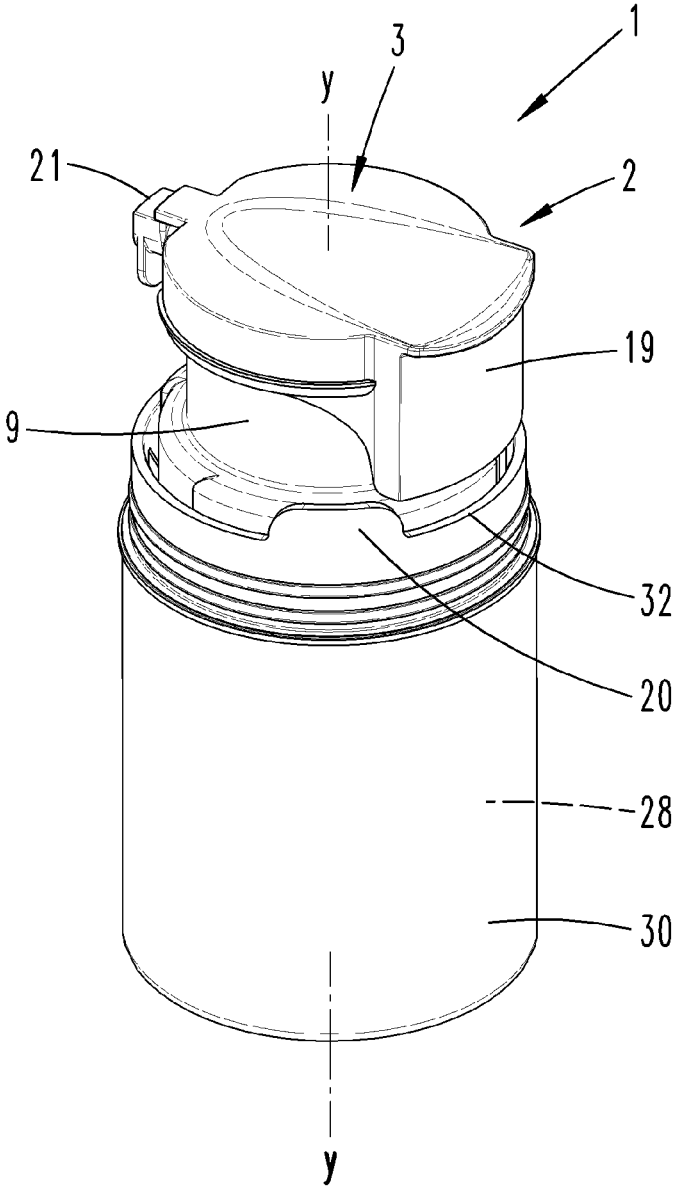
Figure 7:
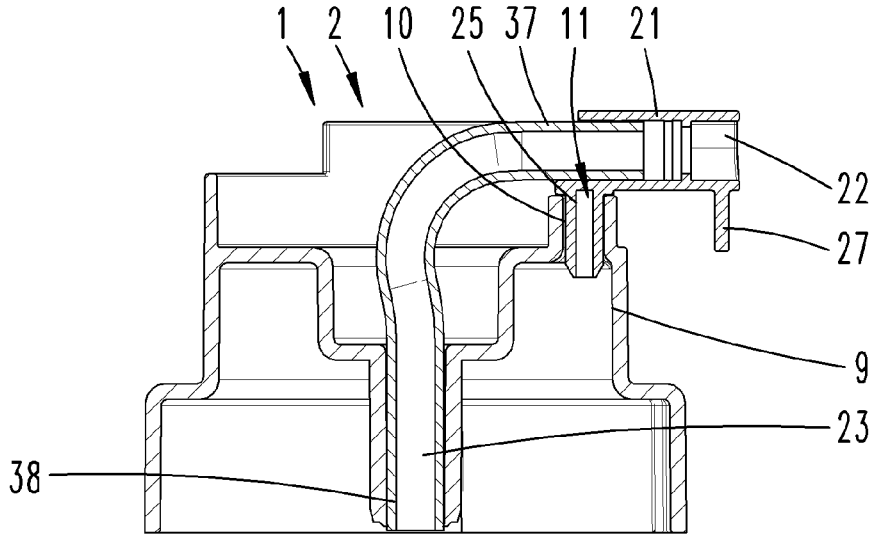
Figure 8:
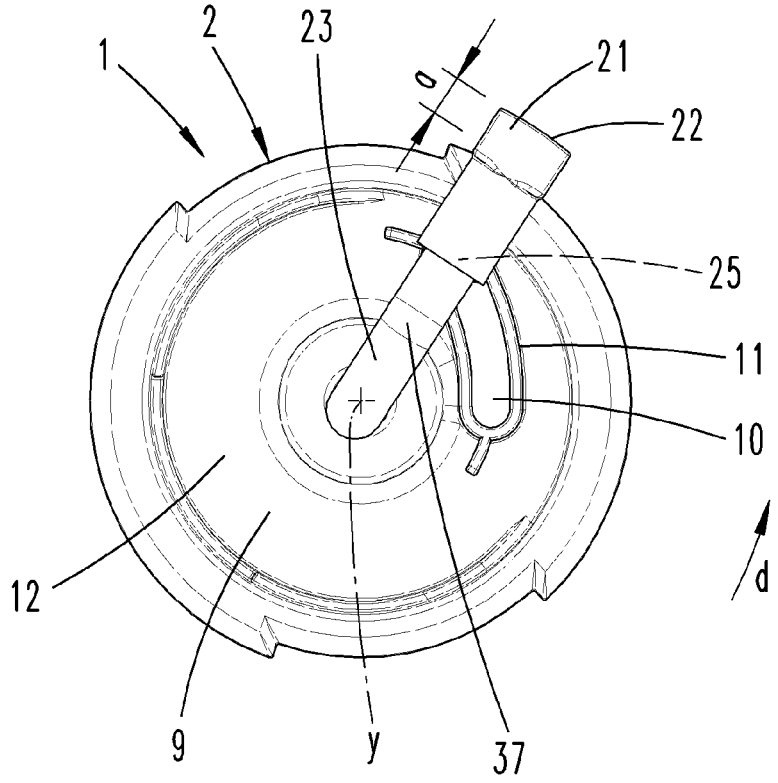
Figure 9:
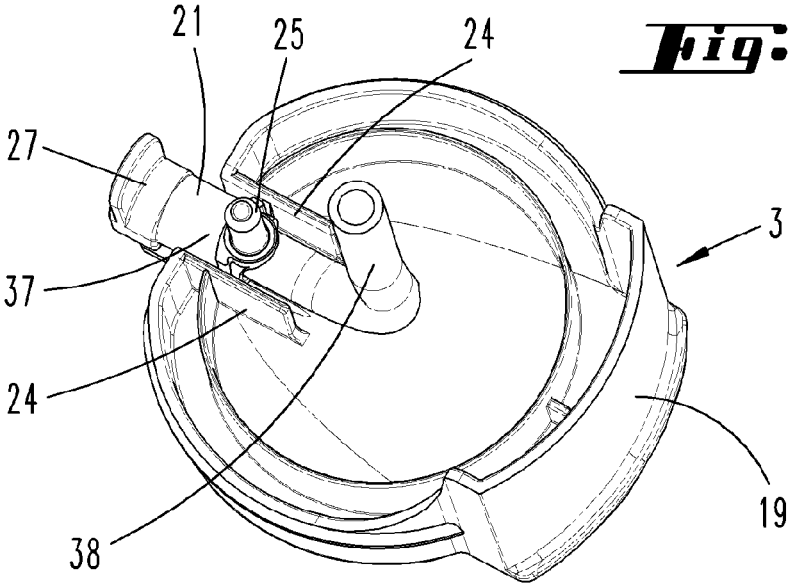
Figure 10:
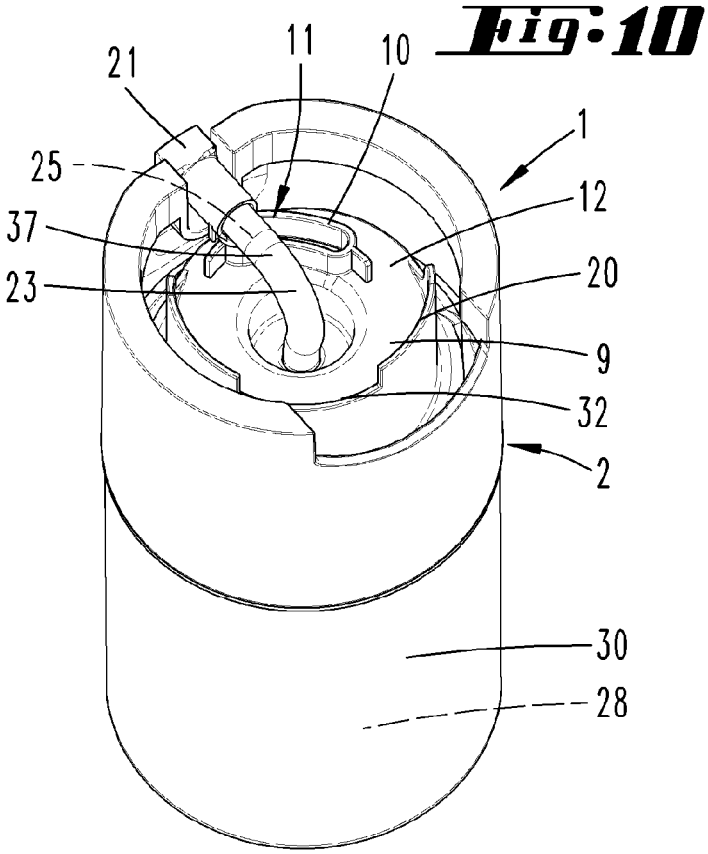
Figure 11:
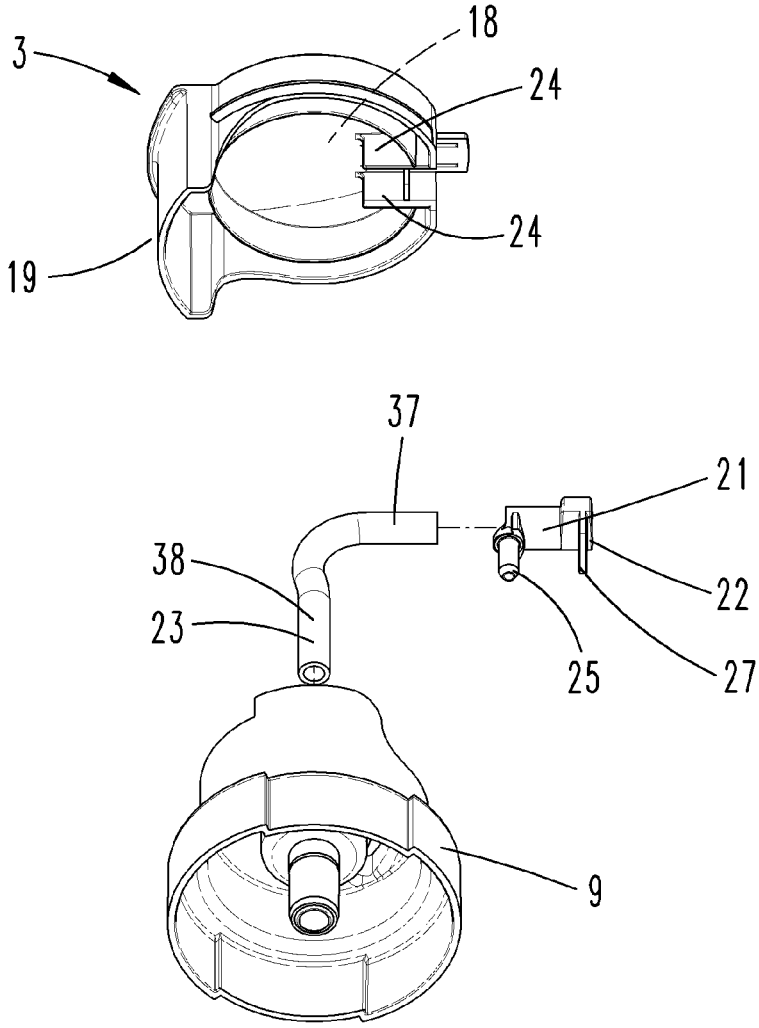
Figure 12:
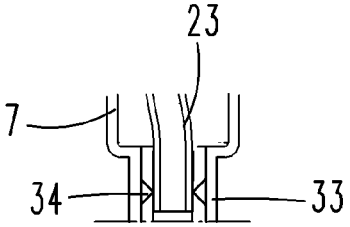
Figure 13:
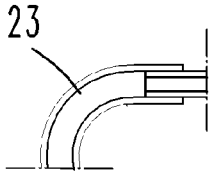
Figure 14:
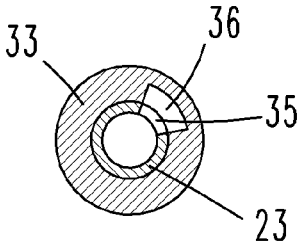
Figure 15:
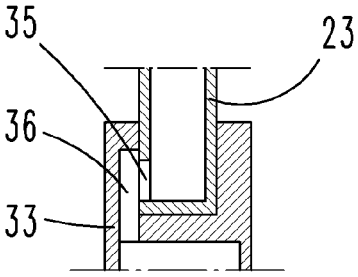
Figure 16:
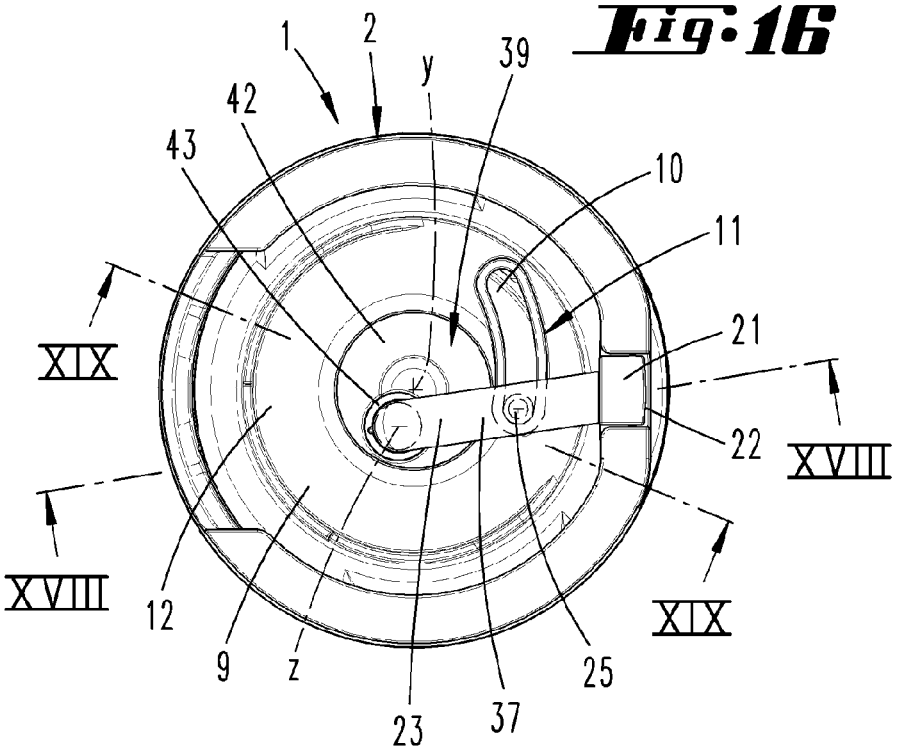
Figure 17:
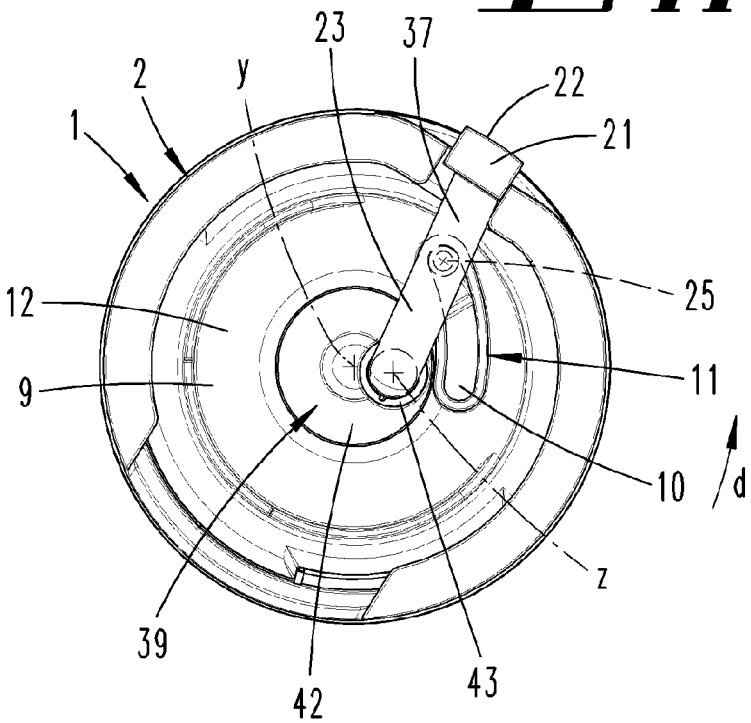
Figure 18:
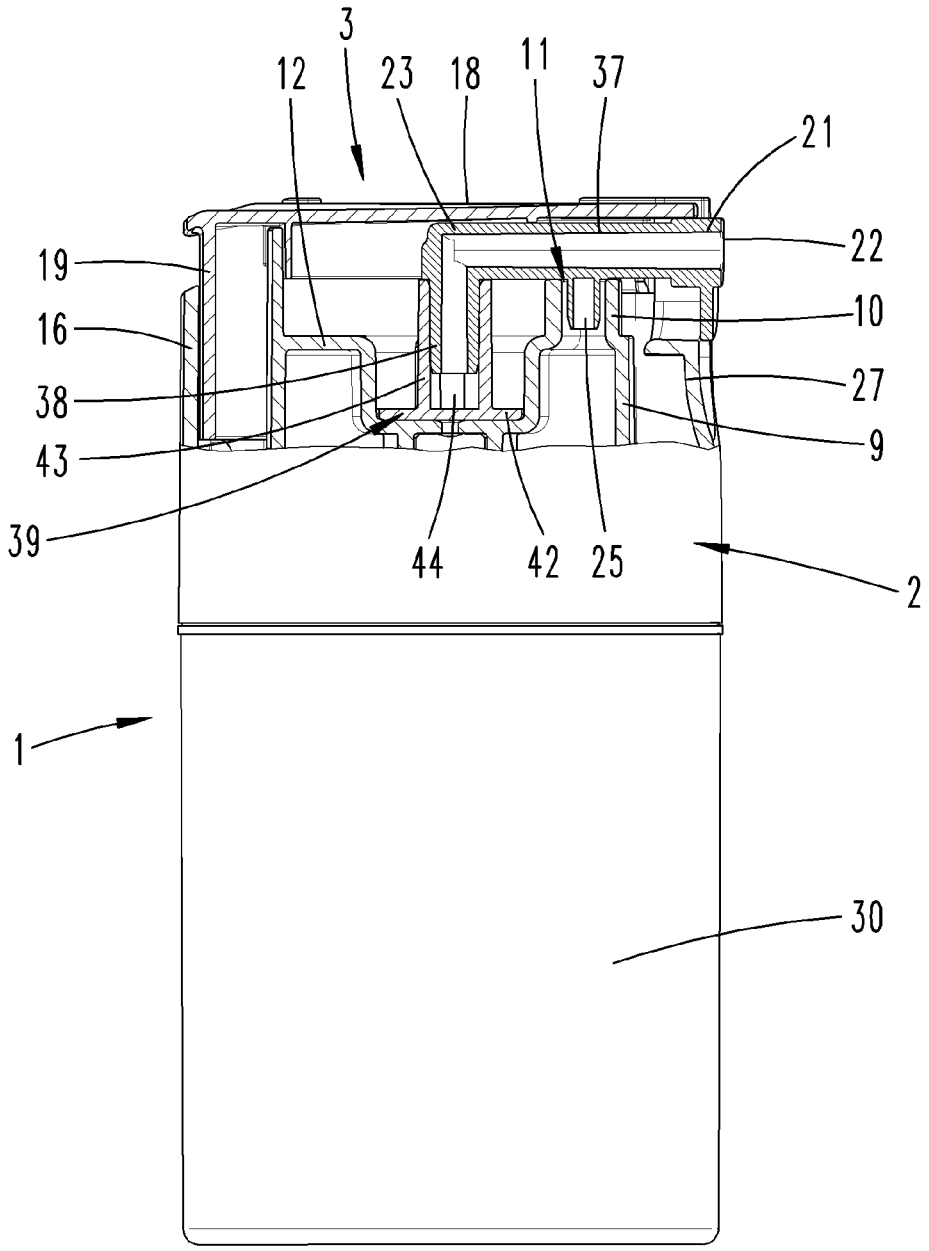
Figure 19:
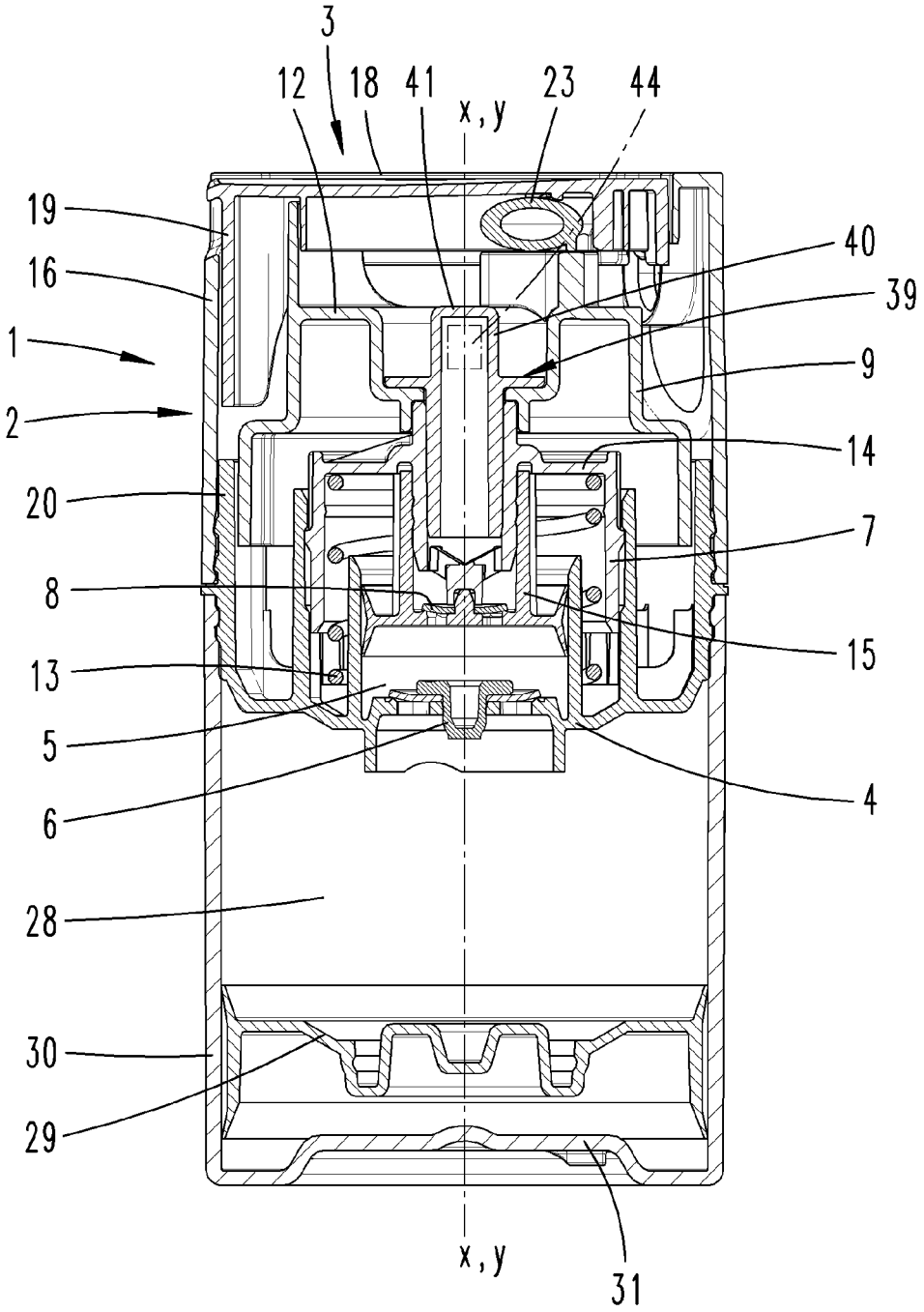
Figure 20:
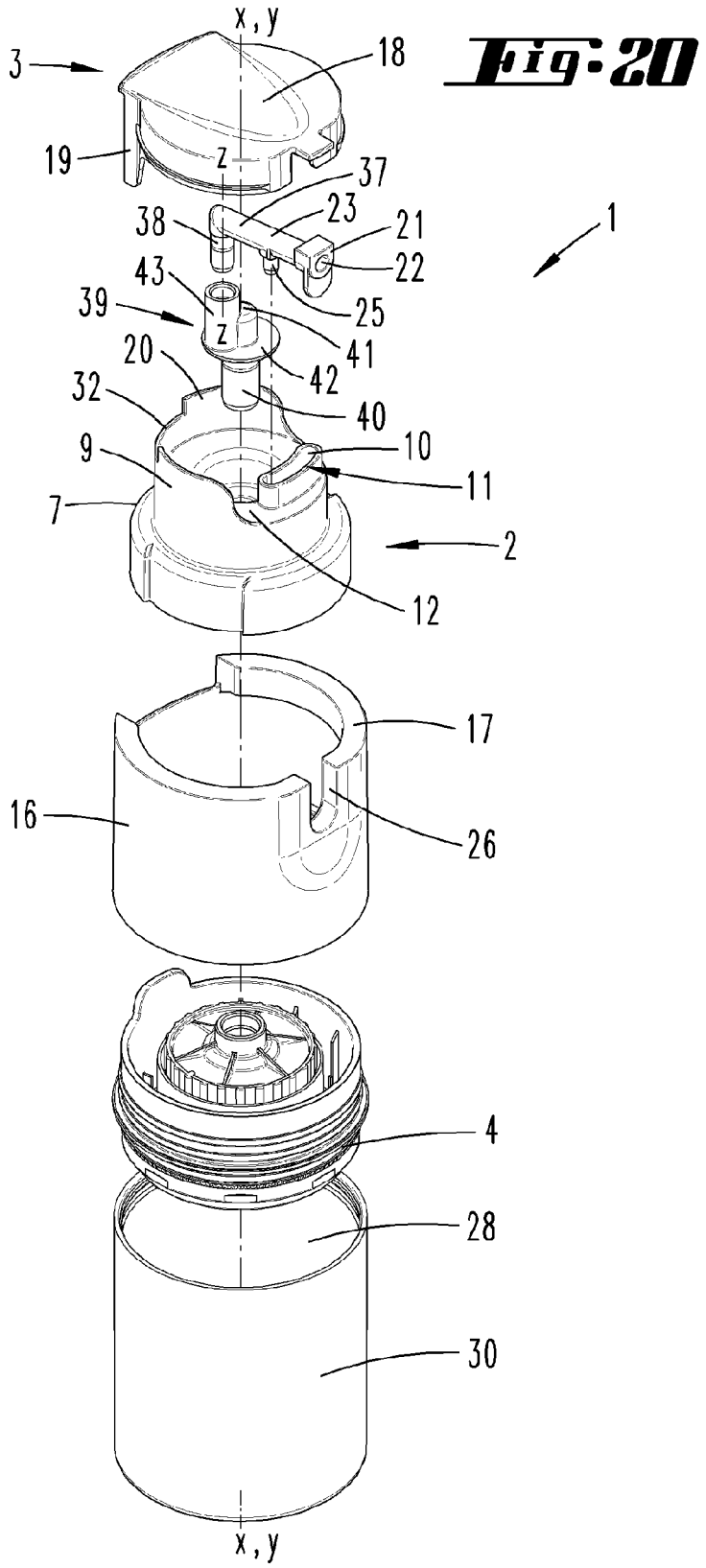
Figure 21:
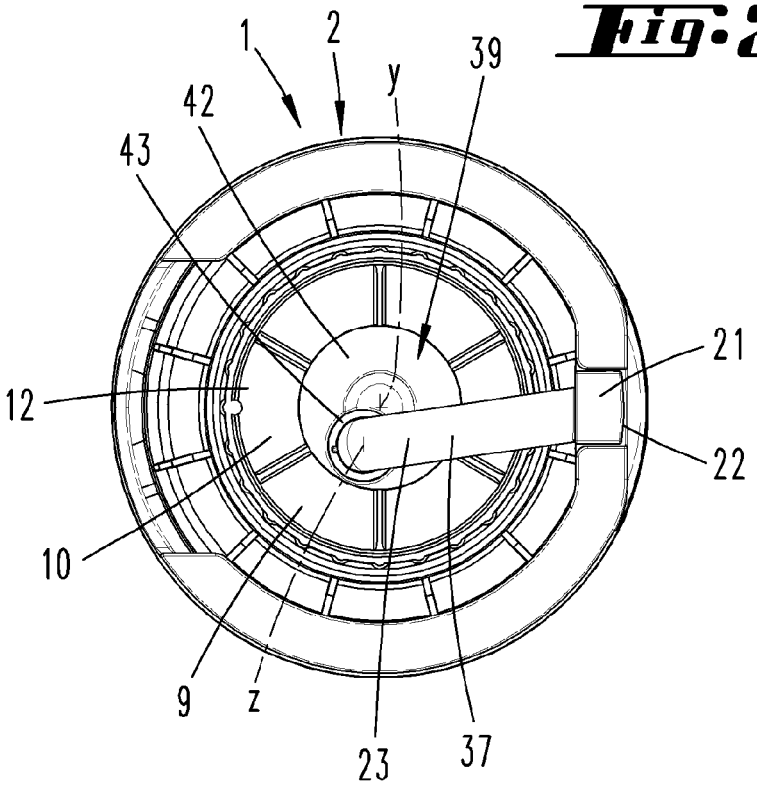
Figure 22:
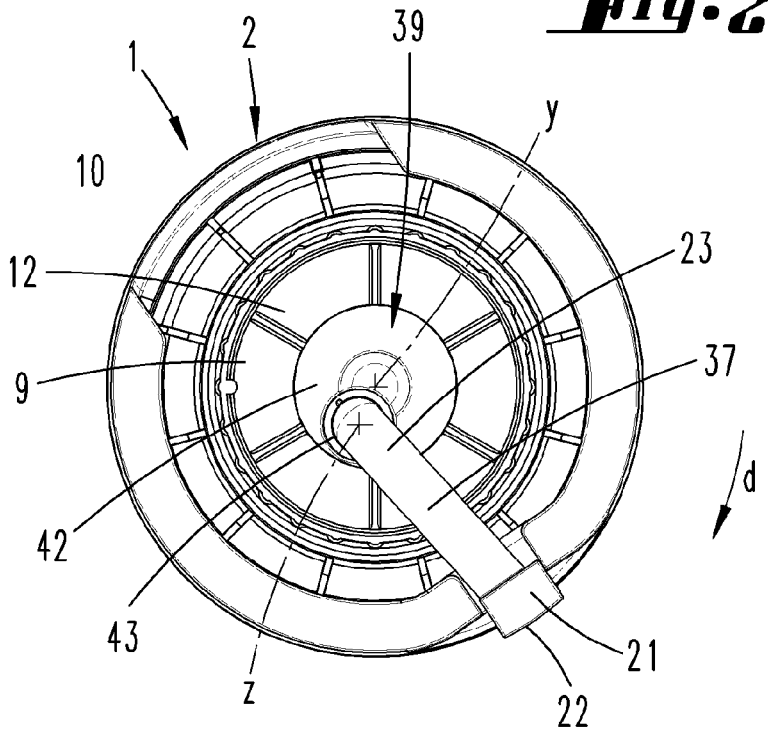

The invention is explained below based on the attached drawing; however, the latter only depicts exemplary embodiments. Therefore, a part that is described only in relation to one of the exemplary embodiments and not (exactly) replaced by another part in an additional exemplary embodiment due to the special feature highlighted therein is also described as a part that can at any rate be present for this additional exemplary embodiment. Shown on the drawing are:

FIG. 1 a perspective view of a dispenser in a first position that impedes actuation;

FIG. 2 another perspective view of the dispenser in the first position according to FIG. 1, omitting a dispenser head part;

FIG. 3 a longitudinal sectional view of the dispenser in the first position;

FIG. 4 a cross sectional view according to the IV-IV line on FIG. 3;

FIG. 5 a view corresponding to FIG. 1, but relating to a second position that results in a dispensing standby position;

FIG. 6 a view corresponding to FIG. 2, relating to the second position according to FIG. 5;

FIG. 7 a longitudinal sectional view through the area of the dispenser head part, relating to the second position;

FIG. 8 a view corresponding to FIG. 4, after a rotational displacement of the dispenser head part into the second position;

FIG. 9 a perspective view from below against an actuating part with a radially movable outlet part guided therein;

FIG. 10 a perspective view of the dispenser in a second position, omitting the dispenser head part and actuating part;

FIG. 11 a perspective, exploded view of a dispenser head part;

FIG. 12 a cutout view of the area according to FIG. 7, relating to an alternative embodiment of a dispenser tube in the connecting area to the pump chamber;

FIG. 13 another embodiment for a telescoping dispenser tube in the area of the connection to an outlet part;

FIG. 14 a cross section of another embodiment for the connection of the dispenser tube to the pump chamber;

FIG. 15 a longitudinal section of the embodiment according to FIG. 14;

FIG. 16 a view essentially corresponding to FIG. 4, relating to another embodiment;

FIG. 17 a view corresponding to FIG. 16, relating to the second position;

FIG. 18 the section according to line XVIII-XVIII on FIG. 16;

FIG. 19 the section according to line XIX-XIX on FIG. 16;

FIG. 20 an exploded, perspective view of the embodiment according to FIG. 16;

FIG. 21 another embodiment of the view according to FIG. 16;

FIG. 22 a view corresponding to FIG. 21, relating to the second position.

A dispenser 1 used for dispensing liquid to pasty masses is shown and described, initially with reference to FIG. 1.

The dispenser 1 exhibits a dispenser head part 2. The dispenser head part 2 incorporates an actuating part 3. The dispenser head part 2 and actuating part 3 simultaneously comprise an outer surface of the dispenser 1, in particular in a first position (locking position) of the dispenser 1 shown on FIG. 1, as well as in a second position that results in a dispensing standby position according to FIG. 5.

Another constituent of the dispenser head part 2 is a pump chamber lower part 4. The latter centrally forms a pump chamber 5, with an inlet valve 6 formed in the pump chamber floor.

The pump chamber lower part 4 interacts with a pump chamber upper part 7 that can be moved relative to the pump chamber lower part 4 along a traversing axis x. The pump chamber upper part 7 carries an outlet valve 8 in the area of an end that plunges into the pump chamber 5 and is sealed against the inner wall of the pump chamber 5. To this end, the pump chamber upper part 7 carries a piston part 15 that projects into the pump chamber and exhibits the outlet valve 8.

The traversing axis x preferably runs parallel to a dispenser body axis. As a whole, the dispenser 1 is essentially rotationally symmetrical in design to this dispenser body axis.

Also non-rotatably and non-displaceably provided with the pump chamber upper part 7 is a dispenser part 9 in the form of an adjusting part. This dispenser part 9 forms a slot 10 of a slot guide 11 that is upwardly open in the direction toward the actuating part 3.

In the illustration on FIG. 4, the slot 10 is comprised of a border formed on a dispenser partial cover 12, which in a layout according to FIG. 4 runs approximately along a circular segment line, the midpoint of which lies further outside the dispenser body axis here depicted with dots in relation to the layout illustration on FIG. 4.

In the area of the walled slot 10, the dispenser part cover 12 is preferably interrupted.

The dispenser part 9 and pump chamber upper part 7, which are non-rotational and non-displaceable relative to each other, can together be shifted under exposure to a restoring force in the direction toward the pump chamber lower part 4.

Provided for resetting purposes is a restoring spring 13 in the form of a cylinder compression spring, which is supported at one end underneath a spring stop shoulder 14 of the pump chamber upper part 7 and at the other end on the pump chamber lower part 4 outside of the pump chamber 5.

The dispenser head part 2 further exhibits a sleeve-like gripping section 16. The latter passes over into a cover 17 interrupted by the actuating part.

In particular relative to the pump chamber lower part 4 and pump chamber upper part 7 with the piston part 15, the gripping section 16 is mounted so that it can turn around a rotational axis y that accommodates the dispenser body axis and is aligned parallel to the traversing axis x. However, it cannot be vertically moved relative to the lower and upper parts of the pump chamber 5, as well as to the dispenser part 9. The gripping section 16 is further non-rotationally joined with the dispenser part 9.

The actuating part 3 is accommodated between the gripping section 16 and dispenser part 9.

The actuating part 3 essentially exhibits an actuating cover 18 that forms an actuating surface, and passes through the gripping section 16 in the area of the cover 17 open toward the top.

The actuating cover 18 passes over into a locking projection 19 that extends radially inward of the gripping section 16. In the vertical sectional view according to FIG. 3, the latter extends essentially perpendicular to the actuating cover 18 in the direction toward the pump chamber lower part 4.

In terms of a projection of the locking projection 19 along the traversing axis x, a stop part 20 is molded onto the pump chamber lower part 4 in the locking first position.

The stop part 20 extends over freely toward the top over an upper, continuous peripheral edge of the pump chamber lower part 4, preferably over a circumferential angle of 10 to 30°.

The locking projection 19 on the actuating part side extends over an angle of 10 to 60° as viewed in the circumferential direction.

In the first position in the illustrations on FIG. 1 to 4, the locking projection 19 extends outside of the stop part 20, wherein a downwardly pointing peripheral edge of the locking projection 19 preferably abuts against the stop part 20. This interrupts a vertical displacement of the actuating part 3 relative to the dispenser head part 2, in particular to the pump chamber lower part 4.

An outlet part 21 is provided opposite the locking projection 19 with respect to the traversing axis x. The latter incorporates an outwardly open dispensing outlet 22.

Inside the dispenser head part 2 and below the actuating cover 18 of the actuating part 3, the outlet part 21 passes over into a dispenser tube 23, the other end of which is joined with the outlet-side area of the outlet valve 8 inside of the piston part 15.

The dispenser tube 23 essentially consists of a tube section 37 that proceeds from an outlet part 21 and extends radially inward and essentially at a right angle to the traversing angle x or rotational axis y, and of vertical tube section 38 that extends essentially in the direction of the traversing axis x or rotational axis y.

The outlet part 21 can be slidably displaced transverse to the traversing axis x relative to the actuating part 3, and further also relative to the dispenser part 9 in particular.

To this end, the outlet part 21 is guided to the actuating part 3 for radial movability. Two wall sections 24 flanking the outlet part 21 are molded onto the actuating part 3 underneath the actuating cover 18.

A sliding block 25 is molded onto the outlet part 21. It engages into the slot 10 of the dispenser part 9.

In the first position of the dispenser head part 2, for example as shown on FIG. 3, the outlet part 21 is further backwardly displaced into a position where the opening plane of the dispensing outlet 22 lies behind an opening plane of a section 26 in the area of the gripping section 16 that allows the outward radial displacement of the outlet part 21.

The cutout 26 flanks the outlet part 21 in a circumferential direction, and provides the latter with an additional guide during a radial displacement of the outlet part 21.

A beard or lobe-shaped cantilever 27 is molded onto the outlet part 21 in the direction of the traversing axis x as viewed underneath the dispenser outlet 22, and in the first position plunges into an area of the cutout 26 in the gripping section 16 that correspondingly expands downwardly.

A storage space 28 is provided underneath the pump chamber 5. A follower piston 29 can be situated in the latter.

The storage space 28 is encompassed by a sleeve-like storage space wall 30 with a storage space floor 31. With the follower piston 29 in place, it acts against the interior side of the storage space wall 30.

The storage space wall 30 preferably exhibits an outer diameter corresponding to the gripping section 16 of the dispenser head part 2, thereby yielding a circular cylindrical shape overall, with a diameter of the dispenser 1 that remains at least approximately constant over the height.

The dispenser head part 2 is joined as a unit with the storage part exhibiting the mass. In particular, the dispenser head part 2 is snapped onto the storage part, in particular in an area where the pump chamber lower part 4 and storage space wall 30 interact.

As evident specifically from FIG. 3, for example, the actuating part 3 in the locked first position is secured against a linear displacement in the direction of the traversing axis x as the result of being supported by means of a locking projection 19 on the stop part 20 fixed on the dispenser. This prevents the pump from moving, and hence mass from being dispensed.

The second position (dispensing standby position) shown on FIG. 5 to 8 must first be reached for dispensing the mass.

By grabbing the sleeve-like gripping section 16 and rotationally displacing the latter relative to the dispensing part 9 non-rotationally connected with the pump chamber lower part 4 and thereby with the storage part, the actuating part 3 is rotationally entrained as the result of the positive accommodation of the actuating part 3 in the gripping section 16. The actuating part-side locking projection 19 exits the area of the stop part 20 fixed on the dispenser, and is shifted into an area that allows the actuating part 3 to be downwardly displaced in the direction of the traversing axis x.

During the rotational movement of the gripping section 16 and actuating part 3, the sliding block 25 simultaneously runs in the slot 10. The slot guide 11 provides a rotational stop both for defining the first position (locking position) and for defining the second position (dispensing standby position).

Due to the interaction between the sliding block 25 and slot 10, the rotational movement of the actuating part 3 is superposed by a sliding displacement of the outlet part 21 from radially inward to radially outward, whereupon the dispensing outlet 22 in the second position protrudes radially outward by measure a over the opening plane of the cutout 26.

In the exemplary embodiment shown, measure a corresponds to one twentieth to one tenth of the maximum dispenser outer diameter b. In another embodiment, the radial displacement measure of the outlet part 21 corresponds to 0.7 to 1.5 times, for example, or 1 times, for example, of the inner diameter of the dispenser tube 23.

In particular, the rotational displacement from the first position into the second position and vice versa takes place over an angle of 40 to 80°, in particular 60°.

In the second position, the locking projection 19 of the actuating part 3 lies opposite an insertion recess 32 of the non-rotational pump chamber lower part 4, which in addition cannot be shifted in the direction of the traversing axis x.

The dispenser tube 23 is preferably designed as a hose part, in particular as a soft plastic hose part, as also depicted.

The dispenser tube 23 is also elastically deformable in design, so that it can also follow the relative twisting of the outlet part-side end relative to the piston part-side, attached end. In addition, the radial displaceability of the outlet part 21 can also be followed, in particular given a hose-like configuration of the dispenser tube 23.

The mass can be dispensed from the second position via the dispensing tube 23 and dispensing outlet 22 by lowering the actuating part 3, in particular by pressing the actuating cover 18 with a finger, which also entrains the pump chamber upper part 7.

A bead-like depression that envelops the cutout 26 in the gripping section 16 makes it easier to remove the mass dispensed via the dispensing outlet 22.

As an alternative, the dispensing tube 23, as shown by example on FIG. 12, can be allocated to the piston part 15, and mounted so that it can rotate relative to the piston part 15. To this end, the piston part 15 or pump chamber upper part 7 has formed on it a receiving part 33 extending along the traversing axis x, into which the allocated free end of the dispenser tube 23 engages. This free end of the dispenser tube 23 acts with a piston-like section 34 in conjunction with the inner wall of the receiving part 33. The piston-like section 34 allows the dispenser tube 23 to rotate relative to the receiving part 33, while in the process preserving the necessary seal between the dispenser tube 23 and receiving part 33.

To allow the dispensing tube 23 is to radially move during the radial displacement of the outlet part 21, the dispensing tube 23 can have a telescoping design as illustrated on FIG. 13, in particular in the area facing the outlet part 21.

In conjunction with a piston part-side configuration of the dispensing tube 23 as illustrated on FIG. 12, for example, it is also possible to provide a dispensing tube 23 that cannot be elastically deformed. In addition, the rotational and/or radial displacement can also be achieved with a toggle lever configuration of the dispensing tube 23.

FIGS. 14 and 15 show another alternative configuration for the connection of the dispensing tube 23 to the pump chamber upper part 7, and by way of the latter to the piston part 15.

To this end, the receiving part 33 on the pump chamber upper part side exhibits a cover, with an upwardly open, central opening that passes over into a channel 36 oriented radially outward up to the wall of the receiving part 33. This radial channel 36 is joined with a lateral, axially aligned branch channel, which ultimately empties into the interior space of the piston part 15.

The free end of the dispenser tube 23 plunges through the cover-side opening. The latter has a radial opening 35 in the tube wall, which extends in the plane of the radial channel 36 of the receiving part 33.

As the gripping section 16, and hence the actuating part 3, is turned, the dispensing tube 23 is turned around the dispenser axis, i.e., around an axis aligned parallel to the traversing axis x, into a position where the opening 35 is aligned with the radial channel 36 for the potential dispensing of the mass.

FIG. 16 to 20 show another embodiment in particular of the dispenser head part 2.

The latter exhibits an eccentric part 39 that interacts with the pump chamber upper part 7.

The eccentric part 39 exhibits a riser 40 that intersects the area of the spring stop shoulder 14 of the pump chamber upper part 7 and empties essentially in the space of the piston part 15. The latter is centrally arranged relative to the rotational axis y. The riser 40 extends vertically upward until into an area of the dispenser part 9 depressed like a pot. The riser 40 exhibits a riser cover 41 in the direction toward the actuating part 3.

The riser 40 is further enveloped radially outward by an attachment collar 42 that is radially aligned relative to the rotational axis y. The attachment collar 42 is used to support the riser 40, and hence the eccentric part 39, on the facing surface of the pot-like depression of the dispenser part 9.

A tube connection 43 is formed on the upper side of the attachment collar 42 (resting thereon) at a radial distance from the rotational axis y. In particular its inner diameter is preferably adjusted to the free inner diameter of the riser 40.

The eccentric axis z of the tube connection 43 runs parallel to the rotational axis y, and is preferably positioned in such a way that the tube connection 43 partially cuts the riser 40 as viewed from above, in an illustration where the tube connection 43 is represented by a circular line.

The tube connection 43 is closed vertically downward by the attachment collar 42, and opens freely vertically upward.

The intersection between the riser 40 and tube connection 43 yields a radial passage 44 between the latter, wherein mass is conveyed from the riser 40 into the tube connection 43 through this radial passage 44 while dispensing the mass.

The tube connection 43 accommodates a vertical tube section 38 of the dispensing tube 23.

Preferably directly above the tube connection 43, the vertical tube section 38 passes over into a tube section 37, which is aligned perpendicular thereto, in particular radially aligned, and forms the outlet part 21 at the end side.

Provided on the underside of the tube section 37 is a sliding block 25, which engages into a slot 10 formed on the pump chamber upper part 7 or on the dispenser part 9.

In this embodiment, twisting the gripping section 16 around the rotational axis y also causes the outlet part 21, and by way of the latter the dispensing tube 23, to be rotationally entrained due to the positive accommodation of the outlet part 21 in the actuating part 3. As a result of the interaction between the sliding block 25 and slot 10, the rotational movement is superposed by a sliding displacement of the outlet part 21 from radially inward to radially outward.

This radial displacement is achieved owing to the rotational entrainment of the eccentric part 39 in the described exemplary embodiment, in which the dispensing tube 23 is preferably designed as a hard plastic tube that is not elastic in particular in the radial direction. The vertical tube section 38 that plunges into the tube connection 43 overall turns along with the eccentric part 39 around the rotational axis y, and further preferably simultaneously also around the eccentric axis z within the tube connection 43.

FIGS. 21 and 22 present another embodiment with an eccentric part 39 designed according to the exemplary embodiment described above, which is adjoined by a dispensing tube 23 that is rigid at least in the radial direction. Here as well, the dispensing tube 23 is connected with a tube connection 43 on the eccentric part side by means of a vertical tube section 38.

The eccentric part 39 is not rotatably mounted, but rather non-rotationally held in the pump chamber upper part 7 in this exemplary embodiment. The vertical tube section 38 can also interact with an eccentrically aligned tube connection 43 formed directly on the dispenser part 9.

By turning the gripping section 16 proceeding from the first position that impedes actuation (see FIG. 21), the radial distance between the eccentric axis z and an outer opening plane of the cutout 26 is shortened (as also the case in the exemplary embodiment described above) as the outlet part 21 in the area of the cutout 26 on the actuating part side is entrained, which in a preferred stiffened design of the tube section 37 causes the outlet part 21 situated hereon to correspondingly emerge beyond this opening plane (see FIG. 22).

In a top view, for example according to the illustrations on FIGS. 21 and 22, the gripping section 16 rotates clockwise in this exemplary embodiment, while the corresponding rotation is counterclockwise (rotational direction denoted by arrow d) in the exemplary embodiments described above with a sliding block 11.

The above statements serve to explain the inventions encompassed by the application as a whole, which each taken separately further develop the prior art, at the very least as the result of the following feature combinations, specifically:

A dispenser, characterized in that an outlet part 21 exhibiting the dispensing outlet 22 is radially moved relative to the traversing axis when moving the dispenser head part 2 out of the first position into the second position and vice versa.

A dispenser, characterized in that the outlet part 21 is moved into the radially outer position while twisting the dispenser head part 2 out of the first position into the second position.

A dispenser, characterized in that the outlet part 21 continues radially inward in a tube section 37 that extends essentially at a right angle to the traversing axis x.

A dispenser, characterized in that, in relation to the traversing axis x, the tube section 37 passes over into a vertical tube section 38 that extends in the direction of the traversing axis x.

A dispenser, characterized in that the vertical tube section 38 runs eccentrically to the rotational axis y, along an eccentric axis z parallel to the rotational axis y.

A dispenser, characterized in that the vertical tube section 38 can turn around the eccentric axis z.

A dispenser, characterized in that the vertical tube section 38 can turn around the rotational axis y.

A dispenser, characterized in that the vertical tube section 38 adjoins an eccentric part 39.

A dispenser, characterized in that the eccentric part 39 exhibits an attachment collar 42 that extends concentrically to the rotational axis y.

A dispenser, characterized in that the outlet part 21 is slot guided on a non-rotational dispensing part 9.

A dispenser, characterized in that a part of the slot guide 11 is formed in a dispenser part 9 non-displaceably formed with a pump chamber part.

A dispenser, characterized in that a sliding block 25 is formed on the outlet part 21, and a slot 10 is formed on the dispenser part 9.

A dispenser, characterized in that the outlet part 21 is guided on the actuating part 3 for purposes of radial movability.

A dispenser, characterized in that a dispenser tube 23 that connects a pump chamber 5 with the outlet part 21 is provided.

A dispenser, characterized in that the dispenser tube 23 is arranged on a receiving part 33 that extends along the traversing axis x so that it can rotate relative thereto.

A dispenser, characterized in that the dispensing tube 23 is designed as a hose part that absorbs a rotation owing to elastic deformation.

A dispenser, characterized in that the dispensing part 9 supports the actuating part 3 so that it can rotate relative to the traversing axis x, but cannot move in the direction of the traversing axis.

A dispenser, characterized in that the actuating part 3 preferably exhibits a locking projection 19 opposite the outlet part 21 relative to the traversing axis x that extends in the direction of the traversing axis x, which interacts with a stop part 20 fixed to the dispenser in the first position.

A dispenser, characterized in that the locking projection 19 in the second position lies opposite an insertion recess 32 that extends in the direction of the traversing axis x.

All disclosed features are essential to the invention (taken separately, but also in combination with each other). The disclosure of the application hereby also incorporates the disclosure contents of the accompanying/attached priority documents (copy of preliminary application) in their entirety, also for the purpose of including features in these documents in the claims of the present application. The features in the subclaims characterize self-contained inventive further developments of prior art, in particular to pursue partial applications based upon these claims.

REFERENCE LIST

| | |
|---|---|
| 1 | Dispenser |
| 2 | Dispenser head part |
| 3 | Actuating part |
| 4 | Pump chamber lower part |
| 5 | Pump chamber |
| 6 | Inlet valve |
| 7 | Pump chamber upper part |
| 8 | Outlet valve |
| 9 | Dispenser part |
| 10 | Slot |
| 11 | Slot guide |
| 12 | Dispenser part cover |
| 13 | Restoring spring |
| 14 | Spring stop shoulder |
| 15 | Piston part |
| 16 | Gripping section |
| 17 | Cover |
| 18 | Actuating cover |
| 19 | Locking projection |
| 20 | Stop part |
| 21 | Outlet part |
| 22 | Dispensing outlet |
| 23 | Dispensing tube |
| 24 | Wall section |
| 25 | Sliding block |
| 26 | Cutout |
| 27 | Cantilever |
| 28 | Storage space |
| 29 | Follower piston |
| 30 | Supply space wall |
| 31 | Supply space floor |
| 32 | Insertion recess |
| 33 | Receiving part |
| 34 | Section |
| 35 | Radial opening |
| 36 | Radial channel |
| 37 | Tube section |
| 38 | Vertical tube section |
| 39 | Eccentric part |
| 40 | Riser |
| 41 | Riser cover |
| 42 | Attachment collar |
| 43 | Tube connection |
| 44 | Radial passage |
| a | Measure |
| b | Diameter |
| d | Rotational direction |
| x | Traversing axis |
| y | Rotational axis |
| z | Eccentric axis |

The invention claimed is:

1. A dispenser (1) for dispensing liquid to pasty masses, with a storage space (28) and a dispenser head part (2), wherein a dispensing outlet (22) allocated to the dispenser head part (2) is formed, and the dispenser head part (2) is configured to be turned around a rotational axis (y) from a first position that impedes dispensing actuation into a second position that yields a standby position for dispensing, wherein an actuating part (3) is configured to be moved along a traversing axis (x) for dispensing mass through the dispensing outlet (22) in the second position, wherein an outlet part (21) exhibiting the dispensing outlet (22) is radially moved in relation to the traversing axis (x) while moving the dispenser head part (2) from the first position into the second position and from the second position into the first position, wherein the outlet part is slot guided in a slot guide that is formed in a non-rotational dispenser part (9) that is non-displaceably combined with a pump chamber part.

2. The dispenser according to claim 1, wherein the outlet part (21) is moved into a radially outer position while twisting the dispenser head part (2) from the first position into the second position.

3. The dispenser according to claim 1, wherein the outlet part (21) continues radially inward in a tube section (37) that extends at essentially a right angle to the traversing axis (x).

4. The dispenser according to claim 1, wherein, in relation to the traversing axis (x), the tube section (37) preferably passes over into a vertical tube section (38) that extends in a direction of the traversing axis (x).

5. The dispenser according to claim 1, wherein the vertical tube section (38) runs eccentrically to the rotational axis (y), along an eccentric axis (z) parallel to the rotational angle (y).

6. The dispenser according to claim 1, wherein the vertical tube section (38) is configured to turn around the eccentric axis (z).

7. The dispenser according to claim 1, wherein the vertical tube section (38) is configured to turn around the rotational axis (y).

8. The dispenser according to claim 1, wherein the vertical tube section (38) adjoins an eccentric part (39).

9. The dispenser according to claim 1, wherein the eccentric part (39) exhibits an attachment collar (42) that extends concentrically to the rotational axis (y).

10. The dispenser according to claim 1, wherein a sliding block (25) is formed on the outlet part (21), and a slot (10) is formed on the dispenser part (9).

11. The dispenser according to claim 1, wherein the outlet part (21) is guided on the actuating part (3) for purposes of radial movability.

12. The dispenser according to claim 1, wherein the actuating part (3) exhibits a locking projection (19) opposite the outlet part (21) relative to the traversing axis (x) that extends in a direction of the traversing axis (x), which interacts with a stop part (20) fixed to the dispenser in the first position.

13. The dispenser according to claim 12, wherein the locking projection (19) in the second position lies opposite an insertion recess (32) that extends in a direction of the traversing axis (x).

14. A dispenser (1) for dispensing liquid to pasty masses, with a storage space (28) and a dispenser head part (2), wherein a dispensing outlet (22) allocated to the dispenser head part (2) is formed, and the dispenser head part (2) is configured to be turned around a rotational axis (y) from a first position that impedes dispensing actuation into a second position that yields a standby position for dispensing, wherein an actuating part (3) is configured to be moved along a traversing axis (x) for dispensing mass through the dispensing outlet (22) in the second position, wherein an outlet part (21) exhibiting the dispensing outlet (22) is radially moved in relation to the traversing axis (x) while moving the dispenser head part (2) from the first position into the second position and from the second position into the first position, wherein a dispenser tube (23) that connects a pump chamber (5) with the outlet part (21) is provided, and wherein a free end of the dispenser tube (23) is arranged on a receiving part (33) of an upper part of the pump chamber, the receiving part extending along the traversing axis (x) so that the dispenser tube rotates relative thereto.

15. The dispenser according to claim 14, wherein the dispenser tube (23) is designed as a hose part that absorbs a rotation owing to elastic deformation.

* * * * *